US005722461A

United States Patent [19]

Lake

[11] Patent Number: 5,722,461

[45] Date of Patent: Mar. 3, 1998

[54] EXHAUST HEAT APPLICATION HOSE

[76] Inventor: Marion L. Lake, 10514 Lakespring Way, Cockeysville, Md. 21030

[21] Appl. No.: 775,868

[22] Filed: Jan. 2, 1997

[51] Int. Cl.[6] ..... E03B 7/14; A47L 5/14

[52] U.S. Cl. ..... 138/35; 138/32; 15/313; 15/405

[58] Field of Search ..... 138/35, 32, 155, 138/177, 178; 285/41; 15/405, 313, 410, 414, 250.01, 250.04; 239/129, 130

[56] References Cited

U.S. PATENT DOCUMENTS

| | | | |
|---|---|---|---|
| 1,468,541 | 9/1923 | Nagues | 15/405 X |
| 1,642,292 | 9/1927 | Becker | 15/250.01 |
| 2,562,302 | 7/1951 | Downey | 15/250.04 |
| 4,114,230 | 9/1978 | MacFarland | 15/405 X |
| 4,269,571 | 5/1981 | Shikutani et al. | 15/405 X |
| 4,404,705 | 9/1983 | Thoma | 15/405 X |
| 5,072,486 | 12/1991 | Guarascio | 15/405 X |
| 5,083,340 | 1/1992 | Takahashi et al. | 15/405 X |
| 5,145,218 | 9/1992 | Worley et al. | 138/109 X |
| 5,224,239 | 7/1993 | Cuthbert, Jr. | 15/405 X |
| 5,287,593 | 2/1994 | Sprunger | 15/405 X |
| 5,291,000 | 3/1994 | Hornberger . | |
| 5,387,778 | 2/1995 | Stanger . | |
| 5,390,962 | 2/1995 | Sekiguchi et al. . | |

*Primary Examiner*—Patrick Brinson
*Attorney, Agent, or Firm*—Terrance L. Siemens

[57] ABSTRACT

A hose for capturing and redirecting exhaust gasses of a motor vehicle for heating purposes. The hose is pliant and heat resistant. Apparatus for removably connecting to exhaust pipes of different diameters is provided at one end of the hose. This apparatus includes a manual, self-tightening clamp. A nozzle and handle are provided at the other end of the hose. Optionally, the hose has an extension removably insertable into the nozzle.

1 Claim, 1 Drawing Sheet

EXHAUST HEAT APPLICATION HOSE

BACKGROUND OF THE INVENTION

1. Field of the Invention

The present invention relates to heat distribution apparatus, and more particularly to a flexible conduit for being attached to a source of pressurized heated gas and for directing the heated gas as desired. The source of heated gas is preferably the exhaust pipe of a motor vehicle.

2. Description of the Prior Art

Motor vehicles are typically parked and driven outdoors, where they are subject to exposure to snow, sleet, and in particular, ice. From time to time, these substances interfere with vehicle operation. For example, ice may obscure vision by coating the windows of the vehicle. Ice may immobilize an entry lock. Occasionally, a vehicle will come to rest on a thin sheet or film of ice which causes the vehicle to be unable to gain sufficient traction at the road to proceed. Excessive ice or snow can obstruct access to the door of a vehicle, or cause ingress and egress to be hazardous.

The prior art has suggested heat generating and utilizing appliances to direct heat onto frozen water for removal thereof from surfaces of objects such as vehicles. A device for projecting heat for melting purposes is shown in U.S. Pat. No. 5,387,778, issued to Tim P. Stanger on Feb. 7, 1995. This device incorporates an electrical resistive heating element disposed in a member which is placed advantageously for projecting heat as desired. Unlike the present invention, heat is not projected in the form of a stream of hot gas. Also, the present invention does not consume an energy source to provide the heat it projects.

A mat incorporating an electric resistive heating element is shown in U.S. Pat. No. 5,291,000, issued to Ralph E. Hornberger on Mar. 1, 1994. As in the case of Stanger, the device of Hornberger does not utilize a stream of hot gas and must consume energy to generate projected heat.

Hoses for conducting gasses are well known. Vacuum cleaners are provided with hoses which frictionally engage an associated blower unit. Hand operated powered blowers, utilized typically for clearing leaves from sidewalks, also employ hoses. However, since the present invention Utilizes exhaust gasses, it must be capable of withstanding considerably greater heat than is imposed upon vacuum cleaners and hand held blowers. Therefore it must have heat resistant properties. An example of a flexible, heat resistant hose construction is seen in U.S. Pat. No. 5,390,962, issued to Yumi Sekiguchi et al. on Feb. 21, 1995. However, since the device of Sekiguchi et al. is a joint for an exhaust conduit, it lacks the handle found at one end of the hose of the present invention and an integral clamp found at the other end of the hose. These are important differences between components of exhaust systems for motor vehicles in general and the present invention.

None of the above inventions and patents, taken either singly or in combination, is seen to describe the instant invention as claimed.

SUMMARY OF THE INVENTION

The present invention provides a portable, manually installed conduit for capturing and redirecting motor vehicle exhaust gasses to areas in need of heat. This is a highly efficient and practical solution to the need for localized application of heat in the outdoors. No separate source of energy nor supply of fuel, nor burner for the latter, need be provided. Otherwise waste heat is exploited for a useful purpose.

Windows and locks may be de-iced by automotive exhaust, and patches of the road may be cleared in part by the same. Heat may be recirculated to the radiator, or to another vehicle. For example, a battery of a second vehicle may be heated to increase its electrical capacity for cold weather starting. Engine blocks and radiators of a second vehicle may be heated. Ignition systems may be heated and dried to restore operation lost to moisture. Ladders and steps of building structures proximate the vehicle supplying the heat may be de-iced, dried, or heated by the invention.

Regardless of the actual purpose addressed by the invention, operation exploits heat present in otherwise wasted exhaust gasses. The invention comprises a hose adapted to be temporarily connected to the exhaust system of the vehicle and has structure enabling expedient projection of the exhaust gasses. The novel hose engages the end of the exhaust system of the motor vehicle at its proximal end and its distal end is directed to a location being heated. A clamp is incorporated into the proximal end, so that the hose may be secured to the exhaust system. The distal end preferably includes a nozzle and a handle for manually directing and wielding the nozzle.

Optionally, the distal end includes a socket for frictionally receiving an extension. This is important in enabling work at close quarters to be performed with the nozzle disposed in close proximity to the handle, as occurs typically with de-icing of windows and restoring operability of door locks. Both of these tasks are performed roughly at or above waist level of a standing adult. However, directing heat onto patches of road and low steps requires that the nozzle be lowered to foot level. The extension enables these latter tasks to be performed without requiring the user to kneel on potentially slippery ground surfaces or to bend over,. which imposes strain on the back.

In another option, the proximal end may have an adjustable receptacle for fitting to different sized exhaust pipes.

The hose is flexible, so that the distal end may be directed as desired. The hose, nozzle, and other components subject to heat are heat resistant, so that the invention does not degrade due to heat, and so that the user's hands are not burned.

Accordingly, it is a principal object of the invention to provide a hose for advantageously directing heat of a stream of exhaust gas from a motor vehicle.

It is another object of the invention to provide apparatus enabling the novel hose to be removably connected to the exhaust pipe of a motor vehicle.

It is a further object of the invention to enable the novel hose to be grasped and directed by hand without the hand being burned.

Still another object of the invention is to provide adjustability in connecting to exhaust pipes of different dimensions.

An additional object of the invention is to enable the novel hose to receive an extension at its distal end, for preventing necessity of kneeling or bending over by the user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
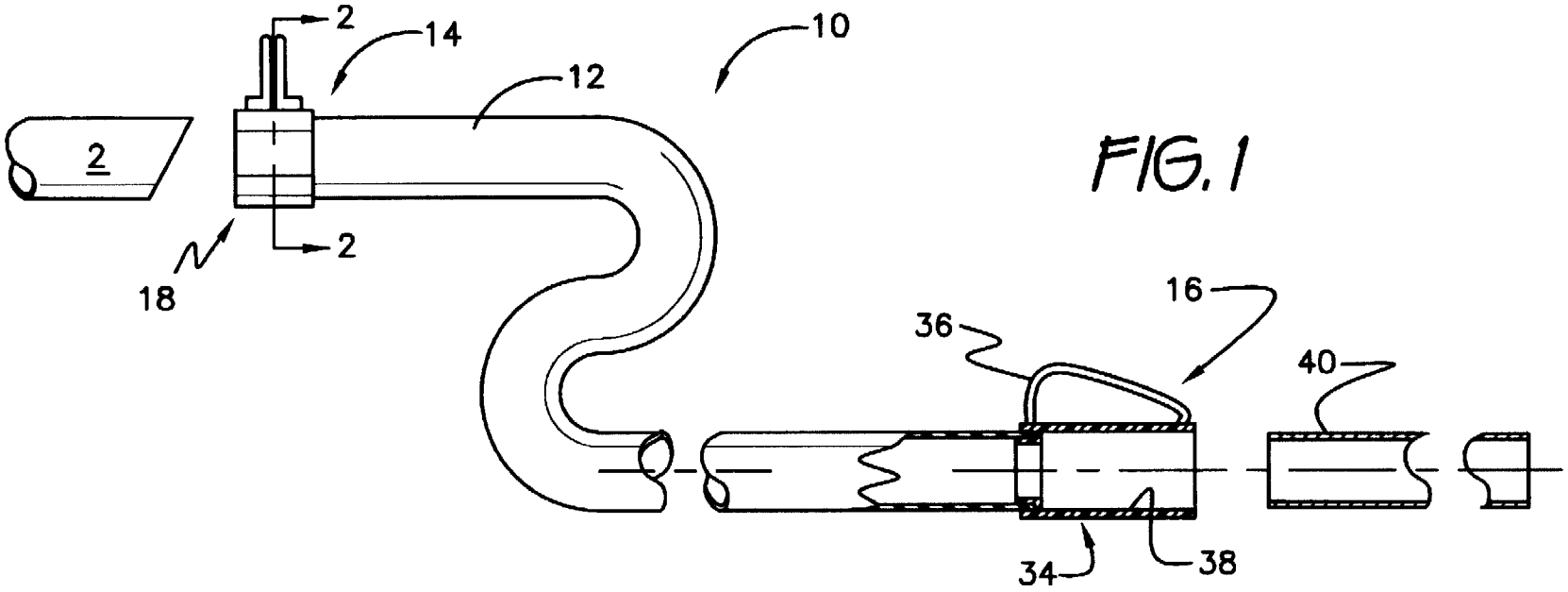
FIG. 1 is an environmental, partially cross sectional view of the invention.

Turning now to FIG. 1 of the drawings, novel hose 10 is shown in a position suitable for installation on the exposed end of an exhaust or tail pipe 2 of a motor vehicle (not shown). Hose 10 comprises a main section 12 a proximal end 14 and a distal end 16. Proximal end 14 is removably connected to exhaust pipe 2 by slipping connection apparatus 18 over exhaust pipe 2 and tightening a clamp 20 more clearly seen in FIG. 2.

Figure 2:
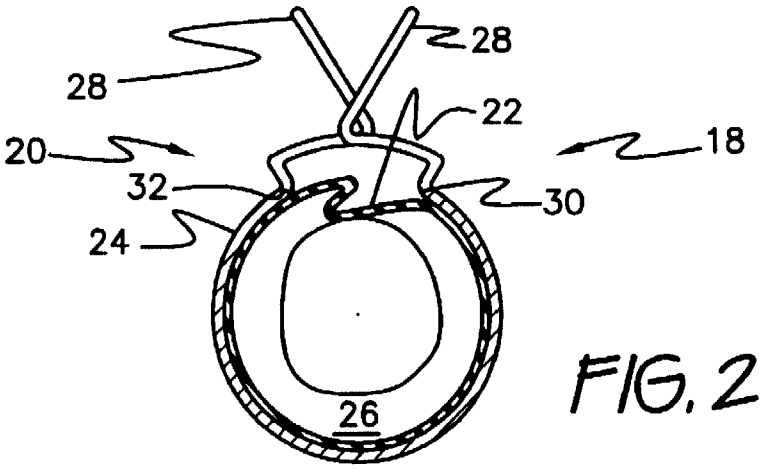
FIG. 2 is a cross sectional detail view taken along line 2—2 of FIG. 1.

In FIG. 2, connection apparatus 18, which is permanently attached to main section 12 of hose 10, is seen to comprise a collar 22 which is slipped over exhaust pipe 2 and clamp 20. Clamp 20 is preferably of a type having a band 24 having spring characteristics urging band 24 to constrict or close over collar 22. Collar 22 is fabricated to be pliant and flexible, so as to adjust in diameter. This characteristic enables collar to adjust for exhaust pipes of different diameters. Connection apparatus 18 joins main section 12 of hose 10 at endwall 26.

Band 24 of clamp 20 need not entirely encircle collar 22, since a leak-tight seal is not critical. Not all of the exhaust gasses discharged from exhaust pipe 2 must be confined to flow within hose 10 for the invention to be effective.

Clamp 20 is permanently retained on collar 22 by any suitable method. For example, band 24 may be embedded within the material constituting collar 22. Alternatively, collar 22 may include tethers (not shown) or similar structure retaining band 24.

Clamp 20 has lever handles 28 each attached to one end 30 or 32 of band 24. When handles 28 are squeezed together at their respective separated ends 30, 32, these ends 30, 32 are forced apart, thereby increasing effective diameter of band 24 and relaxing constriction of collar 22. Lever handles 28 are so called since they pivot about a common point inside band 24. By extending outwardly from this point, they afford leverage for overcoming spring force of band 24 urging band 24 to close. Connection apparatus 18 is installed on and removed from exhaust pipe 2 when constriction is relaxed.

Distal end 16 of hose 10 has a rigid section or nozzle 34 for directing exhaust gasses to be discharged advantageously, or directed appropriately for the task at hand. Nozzle 34 has a handle 36 fixed thereto for manipulating nozzle 34 accordingly.

Nozzle 34 preferably includes a receptacle 38 for receiving an extension 40. Extension 40 is secured by frictional fit within receptacle 38, and is of sufficient length to extend near the ground when nozzle 40 is held at waist height. This arrangement enables a person to direct hot exhaust gasses against ice covering the ground without being forced into an uncomfortable bent over posture. Handle 36 is grasped at about waist height, with the discharge end 42 of extension 40 distant from handle 36, extending to or near ground level.

Main section 12 of hose 10 is fabricated from a pliant yet semi-rigid material. This signifies that main section 12 may be bent at will by manual force, yet is sufficiently rigid to avoid slumping to the point of collapsing or crimping, thereby restricting flow of exhaust gasses. Main section 12, collar 22, nozzle 34, and extension 40 are preferably formed from materials having heat resistant properties capable of withstanding all temperatures less than 250° F. (150° C.).

Many natural and synthetic materials are suitable for fabricating hose 10. Some natural materials include amphiboles and glass preferably in fiber form for flexibility. A number of synthetic materials which are strong, flexible, and temperature resistant have been developed for use in heat resistant apparel and other fire safety applications. These materials are well known and need not be recited herein in detail.

Constituent materials of hose 10 have temperature resistance exceeding 250° F. (150° C.). It will be appreciated that metallic exhaust systems of motor vehicles, dissipate a certain amount of exhaust heat. Temperatures prevailing at the discharge end of the exhaust system are subject to unpredictable variation. It may therefore be desirable to provide materials withstanding much greater temperatures. The temperature cited above is a minimum value for selecting temperature resistance, since this temperature is easily attained in most motor vehicles commercially available today.

Although constituent material of hose 10 has been depicted as homogeneous, other constructions may be substituted. For example, main section 12, collar 22, nozzle 34, and extension 40 may be fabricated utilizing a metal foil and a fiber sleeve concentrically arranged.

The embodiments of the present invention described above are susceptible to many variations and modifications which may be introduced without departing from the spirit of the invention. For example, clamp 20 may take other forms. In another example, handle 36 may attach to main section 12 at distal end 16 rather than to rigid nozzle 34, if desired. Also, extension 40 may thread or otherwise removably attach to nozzle 34. Still other modifications will occur to those of skill in the art.

It is to be understood that the present invention is not limited to the embodiments described above, but encompasses any and all embodiments within the scope of the following claims.

I claim:

1. A hose for advantageously directing exhaust gasses of a motor vehicle for purposes of heating and melting ice, said hose comprising:

a main section fabricated from pliant material having heat resistant properties capable of withstanding temperatures less than 250° F. (150° C.), said main section having a proximal end for attachment to an exhaust pipe of the motor vehicle and a distal end for discharging exhaust gasses;

connection means for removably connecting said hose to the exhaust pipe, said connection means disposed at and permanently attached to said proximal end of said main section of said hose and comprising a pliant and flexible collar and a clamp having lever handles for opening and closing said clamp about said collar over the exhaust pipe of the motor vehicle, said clamp having means for retaining said clamp on said collar;

a rigid nozzle disposed at said distal end of said hose, said nozzle having a raised handle, connected to said nozzle, for manipulating said hose to discharge exhaust gasses advantageously, a receptacle formed in said nozzle, and an extension having means for removably and frictionally attaching to said receptacle of said nozzle, whereby exhaust gasses may selectively be discharged from said hose at a point distant from said handle.

* * * * *